United States Patent [19]

Salvador

[11] 4,217,379

[45] Aug. 12, 1980

[54] METHOD FOR CREATING A SIMULATED BRICK SURFACE OR THE LIKE

[76] Inventor: Silvano E. Salvador, 20490 Melvin, Livonia, Mich. 48152

[21] Appl. No.: 877,858

[22] Filed: Feb. 15, 1978

Related U.S. Application Data

[63] Continuation of Ser. No. 702,503, Jul. 6, 1978, abandoned.

[51] Int. Cl.[2] ..... B05D 5/00; B05D 1/32

[52] U.S. Cl. ..... 427/272; 33/137 R; 101/128.21; 101/129; 428/195; 428/354; 156/280

[58] Field of Search ..... 33/137 R, 180 R; 427/264, 272, 282; 156/247, 280, 344, 71; 428/42, 195, 354; 40/595; 101/128.2, 129

[56] References Cited

U.S. PATENT DOCUMENTS

| | | | |
|---|---|---|---|
| 1,170,521 | 2/1916 | Faison | 33/188 |
| 2,077,828 | 4/1937 | Dombrowski | 33/111 |
| 2,187,087 | 1/1940 | Leary | 33/137 R |
| 2,575,077 | 11/1951 | Snyder | 33/137 R |
| 3,364,088 | 1/1968 | Seman et al. | 427/272 X |
| 3,621,579 | 11/1971 | Dubitsky | 33/137 R |
| 4,082,875 | 4/1978 | Citron | 427/272 X |

*Primary Examiner*—Evan K. Lawrence
*Attorney, Agent, or Firm*—Everett R. Casey

[57] ABSTRACT

A method for creating a simulated brick surface or the like on a surface area which utilizes an adhesive tape provided with two series of marks for demarking the positions of a plurality of such tapes to delineate simulated mortar line areas. A plurality of the tapes are applied in a desired pattern to a surface area, a plastic settable composition is coated over the tapes and surface area, and the tapes are removed together with the coating on the tapes prior to final setting of the composition.

4 Claims, 5 Drawing Figures

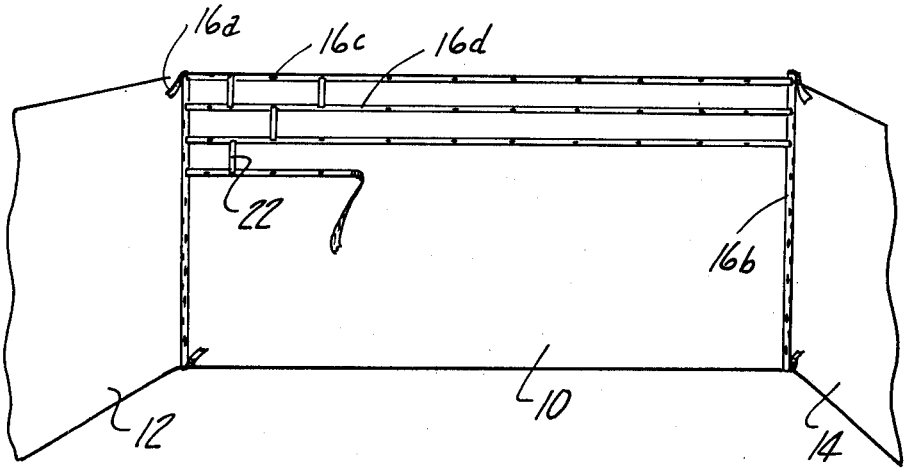
Fig-1
Fig-2
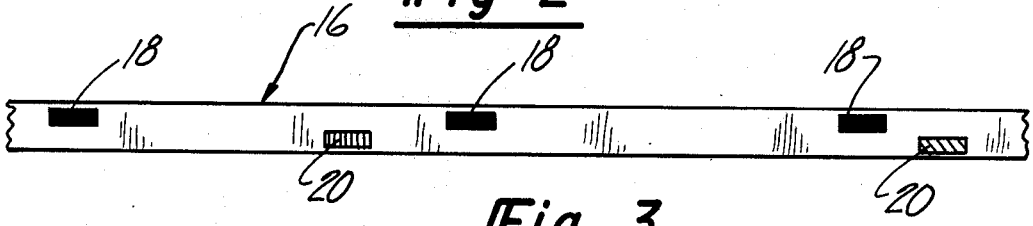
Fig-3
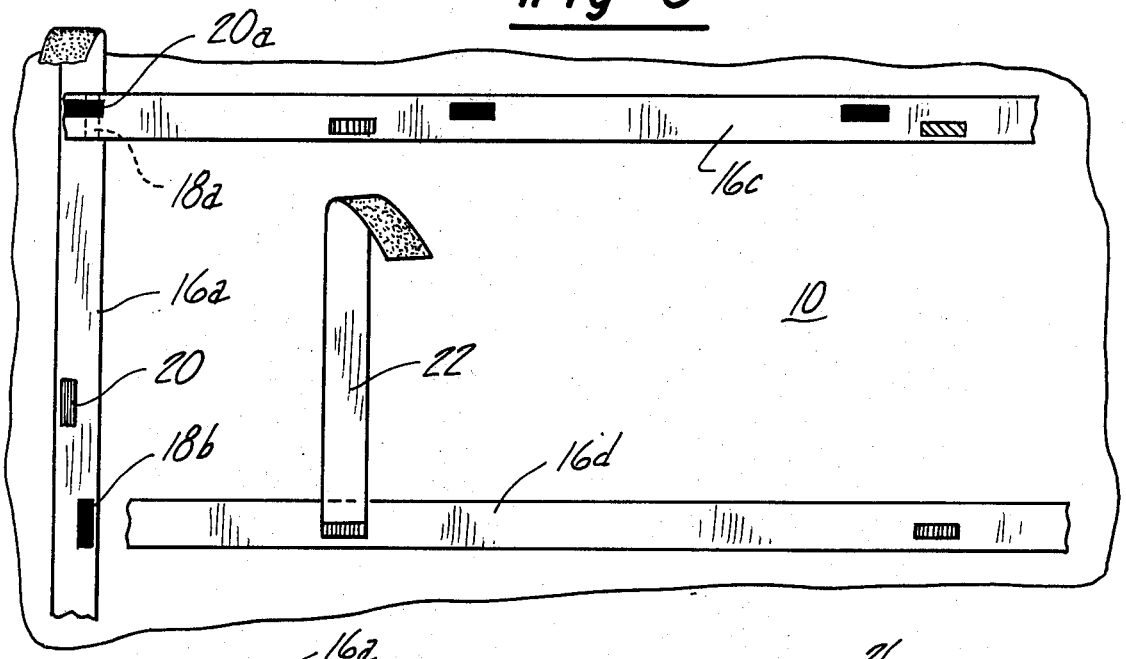
Fig-4
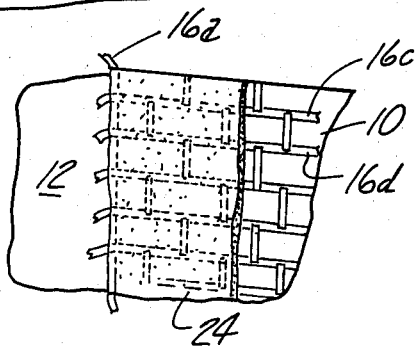
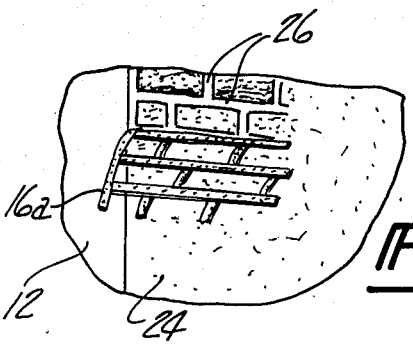
Fig-5

METHOD FOR CREATING A SIMULATED BRICK SURFACE OR THE LIKE

This is a continuation of application Ser. No. 702,503, filed 7-6-78, abandoned.

CROSS REFERENCES

Related patent application for Apparatus and Method for Creating a Simulated Stone Surface or the Like, Ser. No. 875,531, Feb. 6, 1978, which is a continuation of Ser. No. 702,505, July 6, 1976, abandoned; a design patent application for a Decorative Tape System, Ser. No. 006,108, Jan. 24, 1979, which is a continuation of Ser. No. 702,502, July 6, 1978, abandoned; and a design patent application for a Decorative Stone Pattern, Ser. No. 006,107, Jan. 24, 1979, which is a continuation of Ser. No. 702,504, July 6, 1978, abandoned, have been filed by the present inventor.

BACKGROUND OF THE INVENTION

This invention relates to an improved method for creating a simulated brick surface or the like on a surface area.

In a known prior practice, tape was applied, to demark the mortar areas, by placing a ruler marked with coded indicia in a vertical position on a wall and then placing a pencil mark on the wall adjacent each mark on the ruler, and moving the ruler to successive vertically aligned positions to continue the marks on an area taller than the length of the ruler. The ruler was then moved to the other side of the area to be covered, again positioned vertically, and a second series of pencil marks were made upon the wall. The ruler was then placed against the top of the area and parallel to the ceiling and pencil marks were again made upon the wall in alignment with a different set of marks on the ruler. A similar operation was then performed along the bottom of the area. Tapes were then placed horizontally between corresponding pencil marks and then tapes were placed vertically between the pencil marks made at the top and bottom of the area to create a full network of horizontal and vertical tapes. The vertical tapes were then cut at the center of the intersection with each horizontal tape and alternate strips of vertical tape were removed in preparation for the coating of the surface. The surface was then coated with a suitable settable composition which, upon setting, gave the appearance of brick, with the tape being removed prior to setting.

SUMMARY OF THE INVENTION

The method of the present invention greatly simplifies the creation of a simulated brick surface by utilizing premarked tapes which themselves establish the positioning and alignment of the mortarline simulating tape array. A plurality of the tapes are applied in a desired pattern to a surface area, a plastic settable composition is coated over the tapes and surface area, and the tapes are removed together with the coating on the tapes prior to final setting of the composition.

BRIEF DESCRIPTION OF THE DRAWINGS

FIG. 1 is a perspective view of an end wall of a room to a portion of which tapes embodying principles of the present invention have been applied in accordance with a method embodying principles of the present invention;

FIG. 2 is a plan view of a tape used in the installation of FIG. 1;

FIG. 3 is an approximately full-scale view of a section of the tapes of FIG. 2 utilized in combination to define certain areas, together with additional tape strips to provide intermediate delineations;

FIG. 4 is a fragmentary perspective view of a portion of the wall of FIG. 1 after a suitable composition has been applied to a portion thereof; and FIG. 5 is a fragmentary perspective view of the wall of FIG. 4 during the removal of the tapes.

DETAILED DESCRIPTION

The system which is the subject of the present invention is intended to permit a contractor or an owner to create a simulated brick-pattern surface or the like, on a surface area. FIG. 1 of the drawings illustrates an end wall 10 of a room having adjacent side walls 12 and 14. After any advisable preliminary surface treatment (to provide a clean solid surface for the adherence of adhesive tape thereto), the proposed simulated mortar pattern is established on the surface area by means of premarked tape 16. The preferred tape, as illustrated in FIG. 2, comprises an elongate thin flexible severable member coated on one side with adhesive, such as a pressure-sensitive adhesive. The member may be of paper (such as masking tape), cloth, flexible plastic or the like but should be sufficiently strong (including reinforcement if necessary) to be capable of being tensioned into an essentially straight line by the application of tension forces thereto.

In manufacturing the tape 16, a series of separate, discrete marks 18 are spaced at regular intervals thereon. In the preferred arrangement, each of the marks 18 is narrower, transversely of the tape, than the width of the tape, being illustrated to be slightly less than one-half of the tape width. Each of those marks is desirably of a height, longitudinally of the tape, substantially equal to the width of the tape 16.

Tape 16 is further prepared for use by applying thereto a second series of separate, discrete marks 20, desirably of substantially the same individual size as the marks 18 but positioned along or proximate the opposing border of the tape 16, all of the marks in both series being applied to the non-adhesive side of the tape.

The width of the tape determines the width of the simulated mortar lines or joints. The distances between the marks 18 and the distances between the marks 20 determine the simulated brick size. In the preferred form, the tape 16 is about $\frac{3}{8}$ of an inch in width, the distance between adjacent edges of adjacent marks 18 is preferably around $2\frac{1}{4}$ inches and the distances between adjacent edges of adjacent marks 20 is about $3\frac{3}{8}$ inches. Obviously those dimensions may be changed to create a different simulated brick-wall appearance and it is believed that variations of $\frac{1}{8}$ or more in the interval distance will still give the impression of a conventional brick wall. To simulate brick walls made with other size bricks, the dimensions should be correspondingly adjusted.

There is no necessary or critical relationship between the location of the marks 18 longitudinally of tape 16 and the location of the marks 20 longitudinally of the tape 16.

Since the marks 18 and 20 are utilized, as will be seen, for two different tape orientation procedures it is desirable to make them distinctive one from the other either by making them of different shapes or, as preferred, by color coding. In the preferred arrangement, marks 18 are black. Since alternate marks 20 are or may be utilized differently in the final application of the taping system, alternate marks 20 are also desirably distinctively color coded as, for example, by making the marks 20 in the second series of marks of alternating different colors. In the illustration of FIG. 2, the left hand mark 20 is, for example, red and the right hand mark 20, is, for example, green, and alternating successive marks are correspondingly alternately colored.

A roll of the tape 16 of indefinite length may be manufactured for severing by the user either with a tearing force or with shears.

In the preferred method, a first length 16*a* of the tape 16 (FIGS. 1 and 3) is applied vertically along one edge of the surface area 10 with one of the marks 18 adjacent the upper edge of that surface. If the upper edge of the black mark 18 is placed at the upper border, then a simulated mortar joint will appear along that border. If the bottom edge of a mark 18 is placed adjacent that upper border, then a course of simulated bricks will terminate at that upper edge.

In the preferred method, a second strip 16*b* of the tape 16 is then positioned parallel or substantially parallel with strip 16*a* at the opposing edge of the surface 10, with a mark 18 being located, in reference to the upper edge of the surface 10, approximately corresponding with that of the location of the upper mark on strip 16*a*, or in horizontal alignment with the upper mark on strip 16*a*. The tapes, upon application, are pressed against the surface 10 to adhesively adhere them thereto.

Thereupon a further strip 16*c* of the tape 16 is positioned horizontally, tensioned until taut, and adhesively secured to the surface 10 in alignment with the upper marks 18 on the vertical strips 16*a* and 16*b*, the upper mark 18 on the vertical strip 16*a* being denominated 18*a* in FIG. 3 of the drawings. To position the strip 16*c* laterally on the surface 10, one of the marks 20 is aligned with the vertical tape 16*a*, mark 20*a* being so aligned in the view of FIG. 3. Strip 16*c* is pressed in place so as to become adhesively secured to the surface 10.

A further strip 16*d* of the tape 16 is then aligned between the next horizontal pair of marks 18 on the vertical strips 16*a* and 16*b*, one of that next pair of marks being denominated 18*b* in the view of FIG. 3, and tape 16*d* is then adhered in position. Again, one of the marks 20, of a color corresponding to mark 20*a*, is aligned with the strip 16*a* in order to secure vertical alignment of the corresponding pairs of marks 20 on the two strips 16*c* and 16*d*. Correspondingly, additional pieces of the tape 16 are disposed horizontally upon the surface 10 in substantial parallelism with one another and with their vertical spacing being established by the marks 18 on the vertical tapes 16*a* and 16*b*.

In that fashion, the two end vertical simulated mortar lines and the horizontal simulated mortar lines are designated.

The intermediate vertical mortar lines are established by the application of corresponding tape strips 22. If desired, strips 22 may be the same as tape 16 or may be plain since markings thereon have no significance. In the preferred arrangement, a plurality of the strips 22 are employed each of which is, desirably, the same width as the strip 16 and of a length substantially equal to the distance between a pair of adjacent horizontal strips (such as strip 16*c* and 16*d*) plus the width of one of the strips 16 so that each end of a short adhesive strip 22 may be overlapped about half way on the two horizontal strips with which it cooperates. Strips 22, for the appearance of normal-length bricks, are aligned with alternate pairs of the marks 20, that is, with the preferred color coding, with pairs of red marks or with pairs of green marks 20, and are adhered in place. For the simulated appearance of staggered brick, the strips 22 in the next course are aligned with pairs of the oppositely color coded marks 20, that is, with pairs of green or red marks 20, respectively. In this fashion, the simulated mortar lines or joints for the entiresurface 10 are laid out, as is fragmentarily illustrated in FIG. 1 of the drawings.

After the tape is adhered in position, any suitable plastic settable composition may be applied over the surface area 10, including over the previously applied tapes. The material is termed plastic in the sense that it can be readily molded and may be the consistency of a thin mortar or cake frosting. It should be appliable with a spatula or the like, and should not sag or run upon application. The material should be settable, in the sense of having the capacity to set or cure or harden to a rigid surface after the passage of a reasonable time. Any suitable material may be employed. For example, mixtures of limestone, mica, organic binders and thickeners and silica sand may be employed, mixed with water to a suitable consistency. The percentages can be varied widely. As one example, a mixture of 42% limestone, 6% mica, 2% organic binders (such as vinyls) and cellulosic thickeners and 50% silica sand, by volume, may be mixed with water to provide a suitable paste. Coloring may be added if desired. Suitable mixtures are available on the commercial market and do not form a part of the present invention, the only requirement being that the material be applicable in a plastic state to the surface and that it subsequently satisfactorily harden or cure to provide a rigid surface.

The settable plastic composition is applied in an appropriate thickness (such as 1/16 to ¼ inch, more or less) over the area and, if desired for ease of application, over the tapes, as is fragmentarily illustrated in FIG. 4 of the drawings, the composition 24 being illustrated as being smoothed in place. Either immediately or, at the latest, prior to full setting, the entire assemblage of the tapes, together with the composition thereupon, is detached from the surface 10 and removed so as to physically remove and discard not only the tapes but also any material deposited thereupon, to create channels 26 (FIG. 5) simulating mortar lines or joints. If care is used, the strips 22 will remain adhered to the horizontal strips and the horizontal strips will remain adhered to the side vertical strips 16*a* and 16*b* so that the tape area may be removed as a unit. If separation occurs, individual tape sections can be readily removed.

It is to be understood that a variety of other shapes and simulated patterns may be created within the principles and scope of the present invention.

What is claimed is:

1. The method of creating a simulated brick surface or the like on a surface area having at least three edges, which comprises the steps of adhering along a first edge of the area a first length of adhesive, elongate, flexible tape having a first series of discrete marks spaced at regular intervals thereon in the longitudinal direction thereof, with one of said marks being positioned in preselected relation to a second edge of the area extending generally perpendicular to the first edge; adhering along a third edge of the area parallel with the first edge a second length of adhesive, elongate, flexible tape, having thereon a corresponding first series of discrete marks spaced at the same said regular intervals in the longitudinal direction thereof with one of said marks on the second length of tape being positioned in a preselected relation to the second edge of the area corresponding to the positioning of the said one of the marks on the first length of tape in relation to that second edge of the area; adhering a plurality of lengths of adhesive elongate flexible tape in parallel between corresponding marks on said first and second lengths, wherein corresponding marks on each tape are spaced the same longitudinal distance from the said one mark on each respective tape; and further including the step of applying a plastic settable composition as a coating over the surface area and over the adhered tape.

2. The method according to claim 1 further including the step of thereafter removing the tapes together with the composition of the tapes prior to full setting of the composition.

3. The method of creating a simulated brick surface or the like on a surface area having at least three edges, which comprises the steps of adhering along a first edge of the area a first length of adhesive, elongate, flexible tape having a first series of discrete marks spaced at regular intervals thereon in the longitudinal direction thereof, with one of said marks being positioned in preselected relation to a second edge of the area extending generally perpendicular to the first edge; adhering along a third edge of the area parallel with the first edge a second length of adhesive, elongate, flexible tape, having thereon a corresponding first series of discrete marks spaced at the same said regular intervals in the longitudinal direction thereof, with one of said marks on the second length of tape being positioned in a preselected relation to the second edge of the area corresponding to the positioning of the said one of the marks on the first length of tape in relation to that second edge of the area; adhering a first plurality of lengths of adhesive elongate flexible tape having a second series of discrete marks spaced at regular intervals thereon in the longitudinal direction thereof in parallel between corresponding marks on said first and second lengths, wherein corresponding marks on each tape are spaced the same longitudinal distance from the said one mark on each respective tape; adhering a further plurality of adhesive elongate flexible tapes in parallel between selected pairs of corresponding ones of said second series of marks on adjacent ones of said first plurality of lengths of tape; and further including the step of applying a plastic settable composition as a coating over the surface area and over the adhered tape.

4. The method according to claim 3 further including the step of thereafter removing said tapes together with the composition on the tapes prior to full setting of the composition.

* * * * *